US012042715B2

(12) United States Patent
Smith

(10) Patent No.: US 12,042,715 B2
(45) Date of Patent: Jul. 23, 2024

(54) SKATEBOARD TRUCK MOUNTING APPARATUS

(71) Applicant: Nicholas Smith, Beaumont, CA (US)

(72) Inventor: Nicholas Smith, Beaumont, CA (US)

( * ) Notice: Subject to any disclaimer, the term of this patent is extended or adjusted under 35 U.S.C. 154(b) by 246 days.

(21) Appl. No.: 17/625,401

(22) PCT Filed: Jan. 6, 2022

(86) PCT No.: PCT/US2022/070069
§ 371 (c)(1),
(2) Date: Jan. 7, 2022

(87) PCT Pub. No.: WO2022/150829
PCT Pub. Date: Jul. 14, 2022

(65) Prior Publication Data

US 2023/0271080 A1 Aug. 31, 2023

Related U.S. Application Data

(60) Provisional application No. 63/199,546, filed on Jan. 7, 2021.

(51) Int. Cl.
*A63C 17/01* (2006.01)

(52) U.S. Cl.
CPC ..... *A63C 17/017* (2013.01); *A63C 2203/42* (2013.01)

(58) Field of Classification Search
CPC ..... A63C 17/017; A63C 2203/42
See application file for complete search history.

(56) References Cited

U.S. PATENT DOCUMENTS

| | | | | |
|---|---|---|---|---|
| 4,155,565 | A | 5/1979 | Caussin et al. | |
| 4,759,671 | A * | 7/1988 | Duran | F16B 21/125 411/347 |
| 4,930,794 | A * | 6/1990 | Chan | A63C 17/015 280/11.28 |
| 5,704,748 | A * | 1/1998 | Criswell | F16B 39/34 411/304 |
| 5,947,668 | A * | 9/1999 | Thommes | F16B 39/34 411/304 |
| 7,192,039 | B1 | 3/2007 | Snedaker | |
| 9,707,469 | B2 | 7/2017 | Roland et al. | |
| 11,325,020 | B1 * | 5/2022 | McCarthy | A63C 17/12 |
| 2004/0041360 | A1 | 3/2004 | Lukoszek | |
| 2014/0321150 | A1 | 10/2014 | Sandiford | |
| 2022/0409984 | A1 * | 12/2022 | McCarthy | A63C 17/012 |

* cited by examiner

*Primary Examiner* — Brian L Swenson
(74) *Attorney, Agent, or Firm* — Lerner David LLP

(57) ABSTRACT

A skateboard truck mounting apparatus is provided. The skateboard truck mounting apparatus includes a rigid body, having a first hole and a second hole, where the holes are configured to interface with the holes on a skateboard deck. Both the first hole and the second hole are equipped with self-locking mechanisms.

4 Claims, 1 Drawing Sheet

SKATEBOARD TRUCK MOUNTING APPARATUS

CROSS-REFERENCE TO RELATED APPLICATIONS

This is a National Phase Application filed under 35 U.S.C. § 371 as a national stage of International Application No. PCT/US2022/070069, filed on Jan. 6, 2022, an international patent application claiming the benefit of U.S. Provisional Patent Application No. 63/199,546, filed on Jan. 7, 2021, the content of each of which is hereby incorporated by reference in its entirety.

NOTICE OF COPYRIGHTS AND TRADE DRESS

A portion of the disclosure of this patent document contains material which is subject to copyright or trade dress protection. This patent document may show and/or describe matter that is or may become trade dress of the owner. The copyright and trade dress owner has no objection to the facsimile reproduction by anyone of the patent disclosure but otherwise reserves all copyright and trade dress rights whatsoever.

FIELD OF THE EMBODIMENTS

The field of the present invention and its embodiments relate to skateboard truck mounting apparatus. More particularly, the present disclosure relates to a skateboard truck mounting apparatus that can be installed without a separate tool on the truck side.

BACKGROUND

Currently, there are a number of fastening solutions for mounting a skateboard truck to a skateboard deck, all of which have been known in the art for some time. The most widely accepted fastening solution is to individually fasten each bolt or screw to a skateboard truck and skateboard desk by utilizing a small receiving fastener which is equipped with a female-threaded hole. However, despite being the most commonly used solution, this apparatus is very challenging to use because it requires eight receiving fasteners, along with two separate tools: one to engage and turn the bolt and/or screw; and the other to hold said receiving fastener. As any regular skateboarder will attest, this process is very cumbersome and is something that most people who skateboard dread.

Further, the traditional receiving fastener is also prone to rattling loose while the skateboard is in use. Other solutions known in the art attempt to address this issue by providing a fastener which is equipped with some sort of locking system. In these solutions, the locking system is often a device fitted with an adaptive piece made to cradle a receiving fastener with female threading, thereby holding it in a fixed position. However, these solutions fail to adequately address the problem because after a single use, these items deform and cannot be reused, making them costly and inefficient. Moreover, these solutions still require two separate tools to attach to the skateboard deck, resulting in the problems experienced above.

Other solutions to the above issues exist, but those are not without their own caveats. Once such solution is to provide a locking system which utilizes a substance such as nylon or plastic. In these systems the plastic or nylon is affixed to a male-threaded fastener or to a female-threaded receiving fastener in an attempt to increase friction between these components, creating a locking mechanism. However, these systems degrade quickly as the skateboard is used, due to the high stresses put on these components when compared with the strength of the nylon or plastic used. In addition, the production process of these substances are harmful to the environment, making these solutions non-eco-friendly.

Therefore, in light of the above deficiencies in the art, there is demand for an apparatus for mounting a skateboard truck that is durable, easy to install, and does not require the use of multiple tools.

SUMMARY

The present disclosure provides a skateboard truck mounting apparatus, including a rigid member, a first hole located on a first end of the rigid member, a second hole located on a second end of the rigid member, preferably where the second end is opposite to the first end, more preferably where a distance between the first hole and the second hole corresponds to a distance between holes on a skateboard truck baseplate, even more preferably where each of the first hole and the second hole is equipped with a self-locking mechanism.

In an embodiment, the rigid member is configured to at least partially absorb vibrations.

In an embodiment, each of the first hole and the second hole is configured to accept a bolt and/or screw for fastening a skateboard truck baseplate to a skateboard deck. In some embodiments, the rigid member is configured to stabilize any bolts and/or screws, when such bolts and/or screws are inserted into each of the first hole and the second hole.

In some embodiments, each of the first hole and the second hole is threaded.

In some embodiments, the self-locking mechanism is configured to self-lock by employing one or more of: thread manipulation, a pen locking system, a snap or clip system, or thread cutting and/or slicing.

In some embodiments, the rigid member has a left side, a right side, a middle portion, a top surface extending from the left side across the middle portion to the right side, and a bottom surface extending from the left side across the middle portion to the right side, wherein the first hole has a first top opening on the top surface, a first bottom opening on the bottom surface, wherein the second hole has a second top opening on the top surface, a second bottom opening on the bottom surface.

In some embodiments, the self-locking mechanism includes a plurality of segments proximate to each of the first top opening and the second top opening, respectively.

In some embodiments, each of the plurality of segments is threaded such that the plurality of segments is configured to accept a bolt or screw for fastening a skateboard truck baseplate to a skateboard deck.

In some embodiments, each of the plurality of segments is configured to project into the interior of each of the first hole and the second hole such that an area of the first top opening is smaller than an area of the first bottom opening, and an area of the second top opening is smaller than an area of the second bottom opening.

In some embodiments, the plurality of segments is tapered such that an interior area of each of the first hole and the second hole gradually becomes narrower towards each of the first top opening and the second top opening, respectively.

In some embodiments, the plurality of segments is configured to deform when accepting a bolt or screw for fastening a skateboard truck baseplate to a skateboard deck and provide thread manipulation to the bolt or screw, thereby self-locking the bolt or screw in place.

In some embodiments, the deforming of the plurality of segments when the plurality of segments accepts a bolt or screw causes the interior area of the first hole or the second hole to expand.

In some embodiments, the bottom surface is along a plane at the left side and the bottom side, and the bottom surface across the middle portion is above the plane.

In some embodiments, the bottom surface forms a first arch when extending from the middle portion to the first hole. In some embodiments, the bottom surface forms a second arch when extending from the middle portion to the second hole.

In some embodiments, the first arch has a first cutout extending from the bottom surface partially towards the top surface and the second arch has a second cutout extending from the bottom surface partially towards the top surface.

In some embodiments, the first cutout and the second cutout are non-rectangular.

An aspect of an example embodiment in accordance with the present disclosure is to provide a skateboard truck mounting apparatus. In a highly preferred embodiment, the apparatus features a rigid member having a left side, a right side, a middle portion, a top surface extending from the left side across the middle portion to the right side, and a bottom surface extending from the left side across the middle portion to the right side. On this left side is a first hole which has a first top opening along the top surface, a first bottom opening along the bottom surface, and a plurality of cutouts proximate to the first top opening. On the right side is a second hole which has a second top opening along the top surface, a second bottom opening along the bottom surface, and a plurality of cutouts proximate to the second top opening.

The first hole and the second hole are tapered such that the first top opening and the second top opening have a first diameter, and the first bottom opening and the second bottom opening have a second diameter, where the first diameter is less than the second diameter. In these preferred embodiments, the bottom surface is non-linear and changes as it spans across the left side to the right side. Both the first hole and the second hole are equipped with a self-locking mechanism, which employs thread-manipulation to achieve the thread locking.

In various embodiments, the self-locking mechanism can take various forms: a self-locking system that utilizes thread manipulation through the distortion; a self-locking system that utilizes thread manipulation through the threading process; a self-locking system that utilizes additional material to achieve the locking; a self-locking system that utilizes a pen-locking system; a self-locking system that utilizes a snap or clip system; and a self-locking system that utilizes thread cutting or slitting to achieve its self-locking properties.

At the left side and the right side, the bottom surface exists on a plane, which will abut against wherein the bottom surface is along a plane at the left side and the bottom side, and the bottom surface across the middle portion is above the plane. As the bottom surface extends from the first hole to the middle portion and from the middle portion to the second hole, a first arch and a second arch are formed. Preferably, both the first arch and the second arch have non-rectangular cutouts along the bottom surface.

The disclosed apparatus is beneficial over past techniques because it provides an enhanced stability to bolts or screws mounting a skateboard track to a skateboard deck, it reduces the effect of vibration which leads to potential loosening of bolts/screws by self-locking structure to hold said bolts/screws in place; and it reduces the amount of time to mount a skateboard track to a deck dramatically by simplifying the installation process as only one tool is needed.

In various embodiments, the apparatus can be constructed from a variety of materials. Such materials include: metal; metal alloy; hard plastics; and wood. In some embodiments said apparatus is of a single construction. In other embodiments the apparatus is made up of various segments which are configured to be removably attached to the corresponding pieces.

In the present disclosure, where a document, act, or item of knowledge is referred to or discussed, this reference or discussion is not an admission that the document, act, item of knowledge, or any combination thereof that was known at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed. It is contemplated that the claims may encompass one or more of the conventional technical aspects discussed herein.

Implementations may include one or a combination of any two or more of the aforementioned features.

These and other aspects, features, implementations, and advantages can be expressed as methods, apparatuses, systems, components, program products, business methods, and means or steps for performing functions, or some combination thereof.

Other features, aspects, implementations, and advantages will become apparent from the descriptions, the drawings, and the claims.

BRIEF DESCRIPTION OF THE PREFERRED EMBODIMENTS

In the drawings, like elements are depicted by like reference numerals. The drawings are briefly described as follows.

Figure 1:
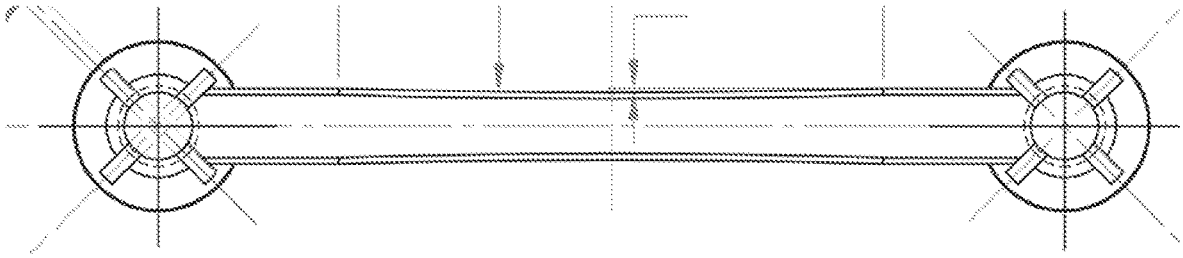
FIG. 1 is a top view of an embodiment of the skateboard truck mounting apparatus in accordance with the present disclosure.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete, and fully conveys the scope of the present disclosure to those skilled in the art. In fact, it will be apparent to those skilled in the art that various modifications and variations can be made in the present invention without departing from the scope or spirit of the invention.

DETAILED DESCRIPTION OF THE PREFERRED EMBODIMENTS

Reference will now be made in detail to each embodiment of the present invention. Such embodiments are provided by way of explanation of the present invention, which is not intended to be limited thereto in any manner whatsoever. In fact, those of ordinary skill in the art may appreciate upon reading the present specification and viewing the present drawings that various modifications and variations can be made thereto.

For purposes of the present disclosure of the invention, unless specifically disclaimed, the singular includes the plural and vice-versa, the words "and" and "or" shall be both conjunctive and disjunctive, the words "any" and "all" shall both mean "any and all".

The present invention quickens and ease the truck to deck mounting process by eliminating the need for a tool on the truck side. The present invention also stabilizes the bolts in a manner that keeps the bolts in place once mounted and secure, and stops or minimizes the shifting of bolts during extreme impact, which can lead to additional stress to the skateboard deck structure and make the deck weaker in durability. This stress can manifest itself in what is known as "stress cracks", which is a sign of a weakened board. The bolts are stabilized by "grounding" one bolt to another via the stabilizing arm structured to hold and transfer force without breaking. The ends of the fastening holes are designed to work together with the stabilizing arm to create a self-locking end to the fastener.

The present disclosure teaches a skateboard truck mounting apparatus comprising a rigid member. In an embodiment, the rigid member has a left side, a right side, a middle portion, a top surface extending from the left side across the middle portion to the right side, and a bottom surface extending from the left side across the middle portion to the right side. In an embodiment, the rigid member is made of a durable rigid material, including but limited to plastic, wood, stainless steel, aluminum, an appropriate metal alloy, or a combination thereof.

In an embodiment, the skateboard truck mounting apparatus comprises a first hole located on a first end of the rigid member. In an embodiment, the apparatus comprises a second hole located on a second end of the rigid member. In some embodiments, the apparatus comprises a plurality of holes each located on different ends of the rigid member. In some embodiments, each hole extends from the top surface to the bottom surface of the rigid member. In an exemplary embodiment, the apparatus comprises a first hole and a second hole, respectively located on a first end and a second end of the rigid member, where the first end and second end are on opposite ends of the rigid member. For example, where the first end is the left end of the rigid member, the second end is the right end of the rigid member. However, three, four, or more holes may also be contemplated in other embodiments of the present apparatus. In some embodiments, each of the first hole and the second hole are configured to accept a bolt or screw for attaching a skateboard truck baseplate of a skateboard truck to a skateboard deck. In some embodiments, each of the first hole and the second hole are threaded, preferably so as to accept the threads of a bolt or screw, even more preferably so as to accept a bolt or screw for attaching a skateboard truck baseplate of a skateboard truck to a skateboard deck.

In some embodiments, each of the first hole and the second hole are located on the rigid member such that the distance between the first hole and the second hole corresponds to a distance between holes on a skateboard truck baseplate, preferably where the holes on the skateboard truck baseplate are holes for accepting a screw or bolt for the purposes of attaching the baseplate of a skateboard truck to a skateboard deck. In embodiments comprising three or more holes, each hole is located on the rigid member so as to correspond to locations of holes on a skateboard truck baseplate. In some embodiments, the rigid member is designed and/or configured to stabilize any bolts and/or screws inserted into each of the first hole and the second hole, preferably by channeling force away from the ends of the rigid member, between each of the first hole and the second hole, and/or away from any screws or bolts when such screws or bolts are inserted into either of the first hole or the second hole, more preferably when such screws or bolts are used to attach the skateboard truck baseplate to the skateboard deck. In some embodiments, the rigid member is designed and/or configured to at least partially absorb vibrations, and/or at least partially mitigate any vibrations of screws or bolts when such screws or bolts are inserted into either of the first hole or the second hole.

In an embodiment, each of the first hole and the second hole is equipped with a self-locking mechanism. Such self-locking mechanisms are well known in the art, especially as it pertains to nuts, such as locknuts, which resist loosening from a bolt or screw under vibrations or torque. Any such self-locking mechanisms, including those used in locknuts, such as thread manipulation (including thread distortion), pen locking, snaps or clips, thread cutting and/or slicing, may be used with the self-locking mechanism of the present apparatus.

In an exemplary embodiment, with reference to FIG. 1, the self-locking mechanism comprises a plurality of segments proximate to the first top opening of the first hole and the second top opening of the second hole. In many embodiments, the plurality of segments is equally spaced across the corresponding hole, with empty spaces between each segment. In some embodiments, the interior face of each segment is threaded, preferably so as to accept a bolt or screw for attaching a baseplate of a skateboard truck to a skateboard deck.

Figure 3:
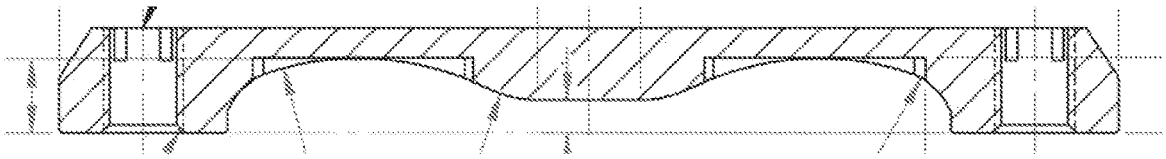
FIG. 3 is a cross-sectional view of the embodiment shown in FIG. 1.

In an exemplary embodiment, with reference to FIG. 3, each of the plurality of segments is configured to project into the interior of each corresponding hole such that the opening of the corresponding hole into the top surface of the rigid member is smaller than the opening of the corresponding hole into the bottom surface. For example, the plurality of segments may project into the interior of each of the first hole and the second hole such that an area of the first top opening is smaller than an area of the first bottom opening, and an area of the second top opening is smaller than an area of the second bottom opening. In a highly preferred embodiment, the plurality of segments is tapered such that an interior area of each of the first hole and the second hole gradually becomes narrower towards each of the first top opening and the second top opening, respectively. For example, each of the plurality of segments may be shaped as a wedge, with the narrower end of each wedge pointed towards the bottom surface of the rigid member, such that the wedge projects further into the corresponding hole as it approaches the top surface of the rigid member, thereby narrowing the corresponding hole.

In an exemplary embodiment, the plurality of segments is configured to deform when accepting a bolt or screw for fastening a skateboard truck baseplate to a skateboard deck and provide thread manipulation to the bolt or screw, thereby self-locking the bolt or screw in place. In some embodiments, the plurality of segments is formed of an elastic, yet durable, deformable material, which is forced outward towards the walls of the corresponding hole, causing the interior area of the first hole or the second hole to expand or widen, when such hole accepts a bolt or screw. In some embodiments, the thread manipulation is created by such deformation, as the threads of the plurality of segments also deform and place friction on the threads of the bolt or screw.

Figure 2:
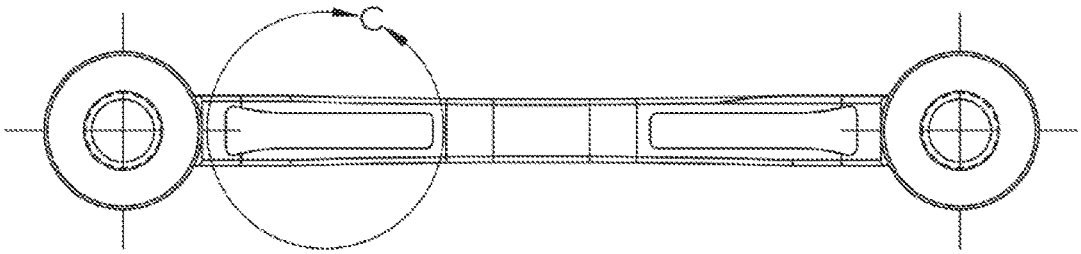
FIG. 2 is a bottom view of the embodiment shown in FIG. 1.

In an embodiment, with reference to FIG. 2, the bottom surface is along a plane at the left side and the bottom side, and the bottom surface across the middle portion is above the plane. In some embodiments, the bottom surface forms a first arch when extending from the middle portion to the first hole. In some embodiments, the bottom surface forms a second arch when extending from the middle portion to the second hole. In some embodiments, the first arch has a first cutout extending from the bottom surface partially towards the top surface. In some embodiments, the second arch has a second cutout extending from the bottom surface partially towards the top surface. In many embodiments, the first cutout and the second cutout are non-rectangular. In an embodiment, one or more of the first cutout and the second cutout serve to channel structural stress, preferably while still accommodating material reduction due to the shape of the cutout.

The disclosed apparatus is unique when compared with other known devices and solutions because (1) it provides an enhanced stability to bolts or screws mounting a skateboard track to a skateboard deck; (2) it reduces the effect of vibration which leads to potential loosening of bolts/screws by self-locking structure to hold said bolts/screws in place; and (3) it also reduces the amount of time to mount a skateboard track to a deck dramatically by simplifying an inherent method of attaching bolts/screws in place.

In an exemplary embodiment, with reference to each of FIG. 1-3 the apparatus includes a body made of stainless steel, where the body is equipped with two holes which are threaded to receive screws or bolts. Here, the body also consists of middle portion between these two holes. Preferably, these two holes are placed apart and aligned to the corresponding holes of a skateboard truck baseplate, with the two corresponding holes being perpendicular to the axel of an attached truck.

In this embodiment, the middle portion is slightly raised to accommodate the truck base plate surface, and there is an arch from each of the holes to this slightly raised middle portion, to allow for an easier grip while handling the apparatus. For each of these holes, the exterior material surrounds the entry point of each hole.

Each of these holes is equipped with a self-locking system that utilizes thread manipulation and/or thread distortion. The top end of each of these holes features four slotted segments, each with a threaded interior. These four slotted segments are formed such that they gradually become narrower towards the top end of the hole when compared with the bottom end of the hole, creating a distortion in the threaded interior. These slotted segments expand when the hole receives a bolt or screw to create a locking friction to prevent said bolt or screw from loosening.

However, it should be noted that these slotted segments do not expand in a uniform manner. That is, the portion of the rigid member that connects the first hole to the second hole does not deform under any circumstance. Therefore, when installed, these slotted segments deform in a direction away from the middle portion of the rigid member, and the middle portion of the rigid member does not move whatsoever.

Moreover, the middle portion of the rigid member does not merely link the first hole to the second hole, it provides stabilization to the entire apparatus.

To install one embodiment of the apparatus in accordance with the present disclosure, a fastener will go through a skateboard deck from the top or grip-taped side of the deck downwards, through the baseplate of a truck, and the fastener is then partially screwed, ¾ of the way into one of the holes of the device from the entry point of the device. Next, the apparatus is aligned with all of the holes on the baseplate of the skateboard truck. Then a second fastener will go through a second hole in the skateboard deck from the top or grip-taped side of the deck downwards, through the baseplate of a truck, and the second fastener is then partially screwed, ¾ of the way, into a second hole of the apparatus. Both of the fasteners are then tightened, and this this process is repeated for the opposite side of the truck baseplate.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," and "third," are used herein to describe various elements, components, regions, layers and/or sections, these elements, components, regions, layers and/or sections should not be limited by these terms. These terms are only used to distinguish one element, component, region, layer and/or section from another element, component, region, layer and/or section. Thus, a "first element," "component," "region," "layer" and/or "section" discussed below could be termed a second element, component, region, layer and/or section without departing from the teachings herein.

Features illustrated or described as part of one embodiment can be used with another embodiment and such variations come within the scope of the appended claims and their equivalents.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below," or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

As the invention has been described in connection with what is presently considered to be the most practical and various embodiments, it is to be understood that the invention is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose the invention, including the best mode, and also to enable any person skilled in the art to practice the invention, including making and using any devices or systems and performing any incorporated methods. The patentable scope of the invention is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

While certain aspects of conventional technologies have been discussed to facilitate the present disclosure, no technical aspects are disclaimed. It is contemplated that the claims may encompass one or more of the conventional technical aspects discussed herein.

Implementations may include one or a combination of any two or more of the aforementioned features.

These and other aspects, features, implementations, and advantages can be expressed as methods, apparatuses, systems, components, program products, business methods, and means or steps for performing functions, or some combination thereof.

Other features, aspects, implementations, and advantages will become apparent from the descriptions, the drawings, and the claims.

In conclusion, herein is presented skateboard truck mounting apparatus. The disclosure is illustrated by example in the drawing figures, and throughout the written description. It should be understood that numerous variations are possible while adhering to the inventive concept. Such variations are contemplated as being a part of the present disclosure.

What is claimed is:

1. A skateboard truck mounting apparatus, comprising:

a rigid member;

a first hole located on a first end of the rigid member;

a second hole located on a second end of the rigid member, wherein the second end is opposite to the first end;

wherein a distance between the first hole and the second hole corresponds to a distance between holes on a skateboard truck baseplate;

wherein each of the first hole and the second hole is equipped with a self-locking mechanism, wherein the rigid member has a left side, a right side, a middle portion, a top surface extending from the left side across the middle portion to the right side, and a bottom surface extending from the left side across the middle portion to the right side, wherein the first hole has a first top opening on the top surface, a first bottom opening on the bottom surface, wherein the second hole has a second top opening on the top surface, a second bottom opening on the bottom surface, and, wherein the bottom surface is along a plane at the left side and the bottom side, and the bottom surface across the middle portion is above the plane.

2. A skateboard truck mounting apparatus, comprising:

a rigid member;

a first hole located on a first end of the rigid member;

a second hole located on a second end of the rigid member, wherein the second end is opposite to the first end;

wherein a distance between the first hole and the second hole corresponds to a distance between holes on a skateboard truck baseplate;

wherein each of the first hole and the second hole is equipped with a self-locking mechanism, wherein the rigid member has a left side, a right side, a middle portion, a top surface extending from the left side across the middle portion to the right side, and a bottom surface extending from the left side across the middle portion to the right side, wherein the first hole has a first top opening on the top surface, a first bottom opening on the bottom surface, wherein the second hole has a second top opening on the top surface, a second bottom opening on the bottom surface, and, wherein the bottom surface forms a first arch when extending from the middle portion to the first hole, and wherein the bottom surface forms a second arch when extending from the middle portion to the second hole.

3. The apparatus of claim 2, wherein the first arch has a first cutout extending from the bottom surface partially towards the top surface and the second arch has a second cutout extending from the bottom surface partially towards the top surface.

4. The apparatus of claim 3, wherein the first cutout and the second cutout are non-rectangular.

* * * * *